US010939720B2

(12) United States Patent
Garrison et al.

(10) Patent No.: US 10,939,720 B2
(45) Date of Patent: Mar. 9, 2021

(54) CYCLING HELMET

(71) Applicant: Trek Bicycle Corporation, Waterloo, WI (US)

(72) Inventors: Jesse Lawrence Garrison, Madison, WI (US); Anthony Albert White, Madison, WI (US); Alan Baryudin, Madison, WI (US)

(73) Assignee: Trek Bicycle Corporation, Waterloo, WI (US)

( * ) Notice: Subject to any disclaimer, the term of this patent is extended or adjusted under 35 U.S.C. 154(b) by 169 days.

(21) Appl. No.: 16/163,756

(22) Filed: Oct. 18, 2018

(65) Prior Publication Data

US 2019/0116909 A1 Apr. 25, 2019

Related U.S. Application Data

(60) Provisional application No. 62/574,370, filed on Oct. 19, 2017.

(51) Int. Cl.

| | |
|---|---|
| ***A42B 3/06*** | (2006.01) |
| ***A42B 3/14*** | (2006.01) |
| ***A42B 3/08*** | (2006.01) |

(52) U.S. Cl.

CPC ..... *A42B 3/066* (2013.01); *A42B 3/08* (2013.01); *A42B 3/14* (2013.01); *A42B 3/142* (2013.01); *A42B 3/145* (2013.01); *A42B 3/147* (2013.01)

(58) Field of Classification Search

CPC combination set(s) only.

See application file for complete search history.

(56) References Cited

U.S. PATENT DOCUMENTS

| | | | | | |
|---|---|---|---|---|---|
| 4,449,275 | A * | 5/1984 | Nava | A42B 3/08 | 24/265 EC |
| 4,996,724 | A * | 3/1991 | Dextrase | A42B 3/066 | 2/411 |
| 5,005,220 | A * | 4/1991 | Gaiatto | A42B 3/08 | 2/421 |
| 5,119,516 | A * | 6/1992 | Broersma | A42B 3/066 | 2/411 |
| 5,231,703 | A * | 8/1993 | Garneau | A42B 3/066 | 2/414 |
| 5,269,025 | A * | 12/1993 | Broersma | A42B 3/066 | 2/411 |
| 5,272,773 | A * | 12/1993 | Kamata | A42B 3/066 | 2/421 |
| 5,351,341 | A * | 10/1994 | Broersma | A42B 3/066 | 2/412 |
| 6,317,896 | B1 * | 11/2001 | Timms | A42B 3/08 | 2/411 |
| 2004/0117896 | A1 | 6/2004 | Madey et al. | | |

(Continued)

FOREIGN PATENT DOCUMENTS

WO WO2017/152151 9/2017

*Primary Examiner* — Khaled Annis

(74) *Attorney, Agent, or Firm* — Bell & Manning, LLC; Christopher Kalafut

(57) ABSTRACT

A cycling helmet includes an outer shell and a closed cell foam layer adjacent to the outer shell. The cycling helmet also includes an inner liner adjacent to the closed cell foam layer. The cycling helmet further includes an insert of energy absorbing material adjacent to the inner liner. The insert is configured to move in multiple directions in response to an impact to the cycling helmet.

12 Claims, 16 Drawing Sheets

(56) References Cited

U.S. PATENT DOCUMENTS

| | | | | |
|---|---|---|---|---|
| 2004/0168246 | A1* | 9/2004 | Phillips | A42B 3/064 2/411 |
| 2006/0248630 | A1* | 11/2006 | Bullock | A42B 3/066 2/421 |
| 2010/0180363 | A1* | 7/2010 | Glogowski | A42B 3/122 2/414 |
| 2010/0281603 | A1* | 11/2010 | Ho | A42B 3/04 2/411 |
| 2013/0042397 | A1* | 2/2013 | Halldin | A42B 3/12 2/411 |
| 2013/0232668 | A1* | 9/2013 | Suddaby | A42B 3/064 2/413 |
| 2013/0239303 | A1* | 9/2013 | Cotterman | A42B 3/08 2/417 |
| 2014/0013492 | A1 | 1/2014 | Bottlang et al. | |
| 2015/0305428 | A1* | 10/2015 | Lakes | A42B 3/142 2/421 |
| 2016/0088884 | A1* | 3/2016 | Guerra | A42B 3/064 2/411 |
| 2016/0242484 | A1* | 8/2016 | Morgan | A42B 3/125 |
| 2016/0262483 | A1* | 9/2016 | Cheng | A42B 3/0446 |
| 2016/0353825 | A1 | 12/2016 | Bottlang et al. | |
| 2017/0164678 | A1 | 6/2017 | Scott et al. | |
| 2017/0231312 | A1 | 8/2017 | Halladin et al. | |
| 2017/0273389 | A1* | 9/2017 | Muller | A42B 3/283 |
| 2017/0290388 | A1 | 10/2017 | Briggs et al. | |
| 2017/0347736 | A1* | 12/2017 | Penner | A42B 3/066 |
| 2018/0271198 | A1* | 9/2018 | Ku | A42B 3/064 |

* cited by examiner

CYCLING HELMET

CROSS-REFERENCE TO RELATED APPLICATION

The present application claims the priority benefit of U.S. Provisional Patent App. No. 62/574,370 filed on Oct. 19, 2017, the entire disclosure of which is incorporated herein by reference.

BACKGROUND

A cycling helmet is often worn by bicyclists as a safety precaution. Traditional helmets utilize a stiff foam material such as expanded polystyrene (EPS) surrounded by a rigid shell to help reduce the peak energy of an impact. Traditional helmets also utilize an adjustable strap system such that the helmet can be securely fastened to the user's head. Additionally, some helmets include foam padding in various areas to improve comfort and prevent chafing.

SUMMARY

A cycling helmet comprises an outer shell and a closed cell foam layer adjacent to the outer shell. The cycling helmet also includes an inner liner adjacent to the closed cell foam layer. The cycling helmet further includes an insert of energy absorbing material adjacent to the inner liner. The insert is configured to move in multiple directions in response to an impact to the cycling helmet.

A method of making a cycling helmet includes forming an outer shell. The method also includes forming an inner liner, and mounting a closed cell foam layer between an inner surface of the outer shell and an outer surface of the inner liner. The method further includes placing an insert of energy absorbing material adjacent to an inner surface of the inner liner. The insert is configured to move in multiple directions in response to an impact to the cycling helmet.

Other principal features and advantages of the invention will become apparent to those skilled in the art upon review of the following drawings, the detailed description, and the appended claims.

BRIEF DESCRIPTION OF THE DRAWINGS

Illustrative embodiments will hereafter be described with reference to the accompanying drawings, wherein like numerals denote like elements. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Traditional cycling helmets often utilize a stiff foam material, such as EPS, to absorb all of the impact in the event of an accident. The impact absorbed by the helmet during an accident can include both direct impact and rotational or oblique impact. During a direct impact in which the helmet contacts an object straight on, the EPS can often effectively absorb the contact and prevent injury to the user due to the (irreversible) compressibility of the EPS. However, during a rotational/oblique impact in which the helmet slides along, rolls along, or glances off an object, traditional EPS helmets are sometimes unable to fully absorb the impact, resulting in a higher likelihood of injury. One reason for the higher likelihood of injury during a rotational impact is that traditional EPS inserts are statically mounted within a shell and are unable to move with the user's head during such impact. As a result, the user's head movement is restricted during an accident, and it is possible that axons in the brain can stretch and/or tear during the rotational/oblique impact.

Described herein is a cycling helmet that utilizes an insert made from energy absorbing material with multi-directional flexibility. The energy absorbing material, which can be made from polycarbonate or a similar material, is able to bend, compress, stretch, and shift in multiple directions without shearing. As discussed herein, the energy absorbing material is maintained in a largely spherical shape within a shell of the helmet such that the material retains its ability to bend, compress, stretch, and shift in multiple directions.

Figure 1B:
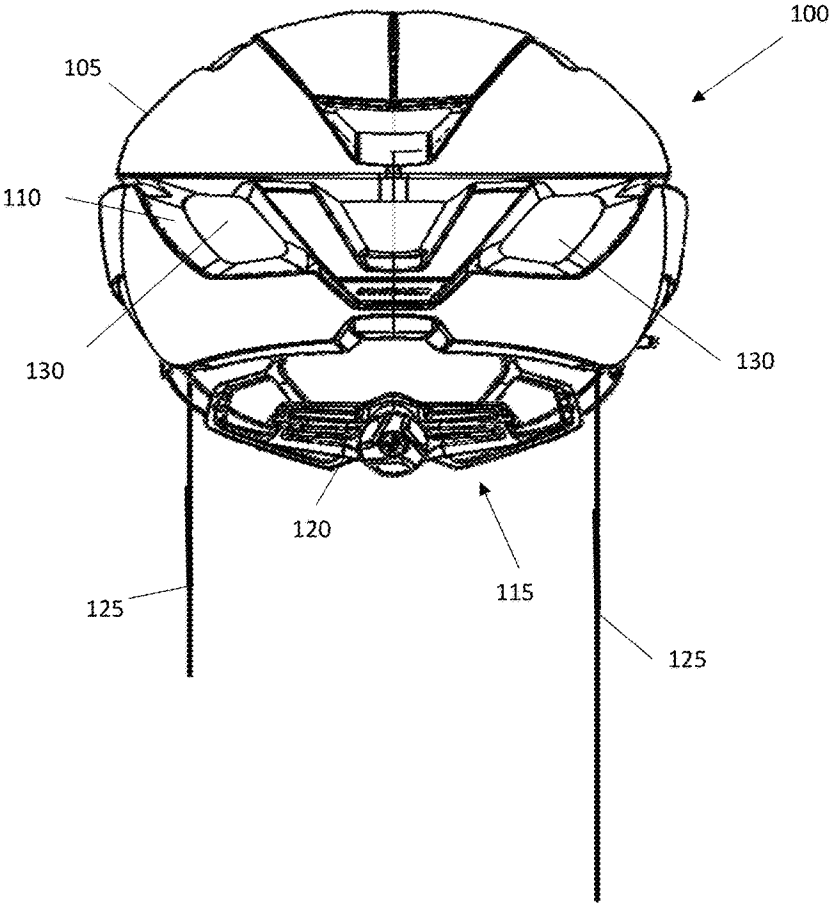
FIG. 1B depicts a rear view of the cycling helmet of FIG. 1A in accordance with an illustrative embodiment.
Figure 1A:
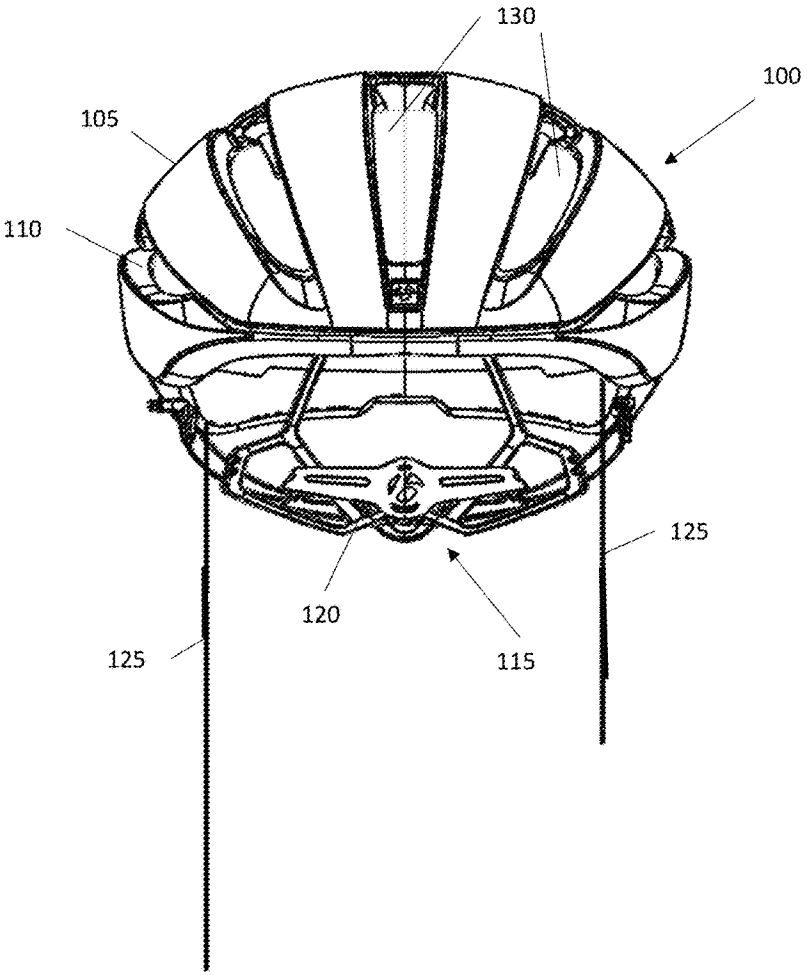
FIG. 1A depicts a front view of a cycling helmet in accordance with an illustrative embodiment.
Figure 1C:
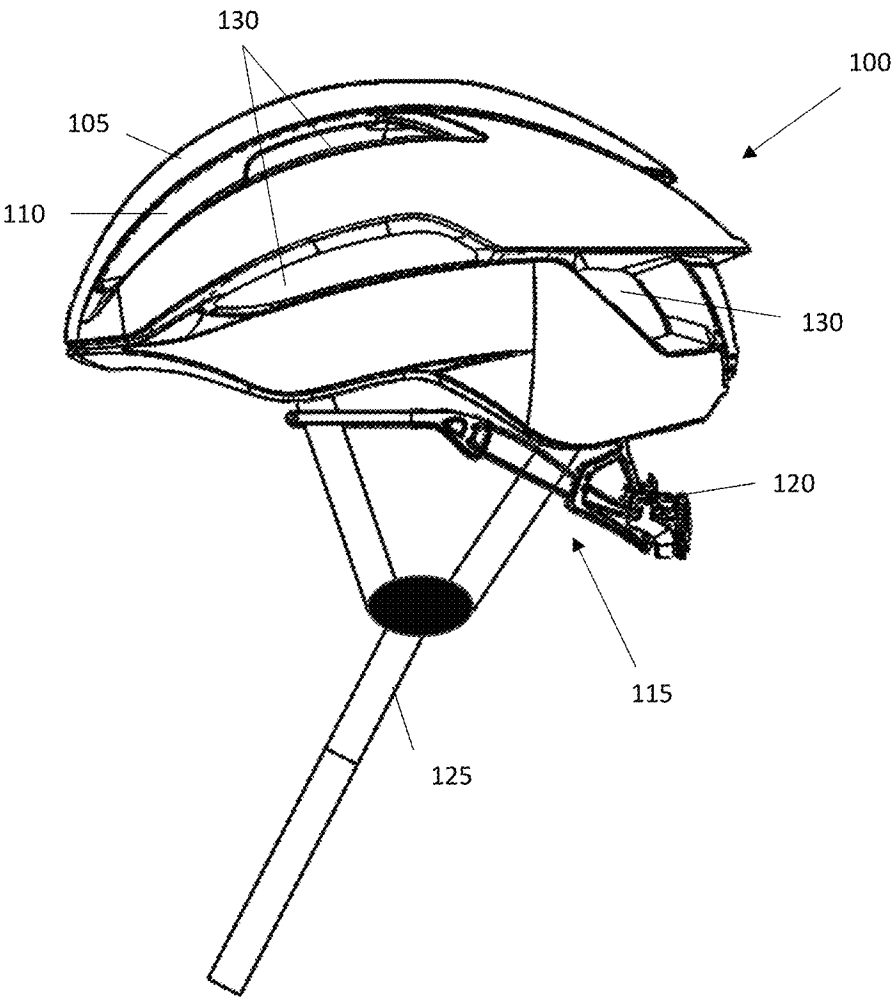
FIG. 1C depicts a side view of the cycling helmet of FIG. 1A in accordance with an illustrative embodiment.

FIG. 1A depicts a front view of a cycling helmet 100 in accordance with an illustrative embodiment. FIG. 1B depicts a rear view of the cycling helmet 100 in accordance with an illustrative embodiment, and FIG. 1C depicts a side view of the cycling helmet 100 in accordance with an illustrative embodiment. As depicted, the cycling helmet 100 includes an outer shell 105 and a closed cell foam layer 110 that is surrounded by the outer shell 105. As depicted in FIGS. 1A-1C, the cycling helmet 100 also includes a fit system 115 that includes a yoke 120 and straps 125 for securing the cycling helmet 100 to a user's head. The fit system 115 is described in more detail below with reference to FIGS. 4A-4K.

The outer shell 105 of the cycling helmet 100 can be made from plastic, resin, fiber, polycarbonate, polyethylene, terephthalate (PET), acrylonitrile butadiene styrene, polyethylene (PE), polyvinyl chloride (PVC), vinyl nitrile (VN), fiberglass, carbon fiber, or other similar material. In addition to housing other components of the cycling helmet 100, the outer shell 105 provides a rigid outer layer. Depending on the implementation, the outer shell 105 can be formed through stamping, molding, vacuum forming, or any other known fabrication technique. The outer shell 105 is formed to include vent openings that form vents 130. The vents 130 are included to improve airflow, increase breathability, and reduce the overall weight of the cycling helmet 100.

Adjacent to the outer shell 105 is the closed cell foam layer 110. In an illustrative embodiment, an inner surface of the outer shell 105 is coated with an adhesive that is used to attach the closed cell foam layer 110 to the outer shell 105. Any type of suitable adhesive may be used. The closed cell foam layer 110 can be formed by blowing, molding, or any other technique known to those of skill in the art. In another illustrative embodiment, the closed cell foam layer 110 can be made of expanded polystyrene (EPS). In alternative embodiments, the closed cell foam layer 110 can be made of one or more layers of the same or similar materials, including an impact energy absorbing material such as expanded polypropylene (EPP), expanded polyurethane (EPU), vinyl nitrile (VN), or any other material that absorbs impact energy through deformation. The closed cell foam layer 110 also includes vent openings that are aligned with the vent openings in the outer shell 105 to form the vents 130. In an illustrative embodiment, the vent openings on the interior side of the closed cell foam layer 110 are chamfered to allow an energy absorbing insert in the cycling helmet to move relative to the vent openings without being restricted by them. The chamfered edges of the closed cell foam layer 110 are depicted and described in more detail with reference to FIG. 7.

The straps 125 of the cycling helmet 100 are used to secure the cycling helmet 100 to a user's head. Any type of adjustable helmet strap may be used. In an illustrative embodiment, the straps 125 include a first strap attached a left side of the cycling helmet 100 and a second strap attached to the right side of the cycling helmet 100. The first strap and second strap are configured to be connected to one another under a user's chin by way of a buckle or clip as known to those of skill in the art. In an illustrative embodiment, the straps 125 are integrated into the fit system 115 that includes the yoke 120 and other components. In an alternative embodiment, the straps 125 may be independent of the yoke 120. The fit system 115 and its components are described in more detail below.

Figure 2B:
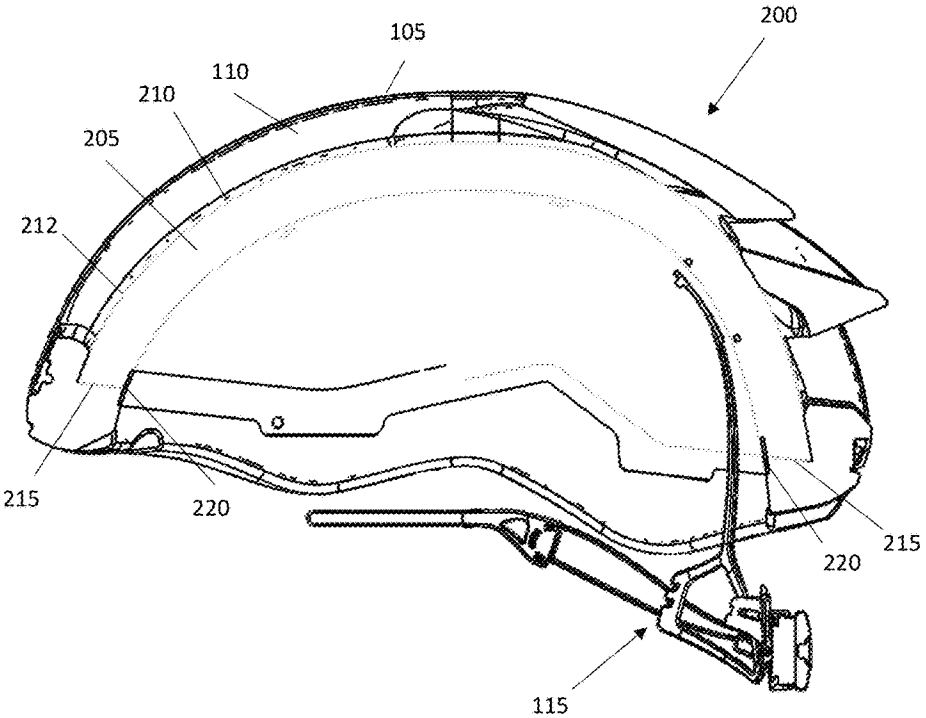
FIG. 2B is a side cross-sectional view of the cycling helmet of FIG. 2A in accordance with an illustrative embodiment.
Figure 2A:
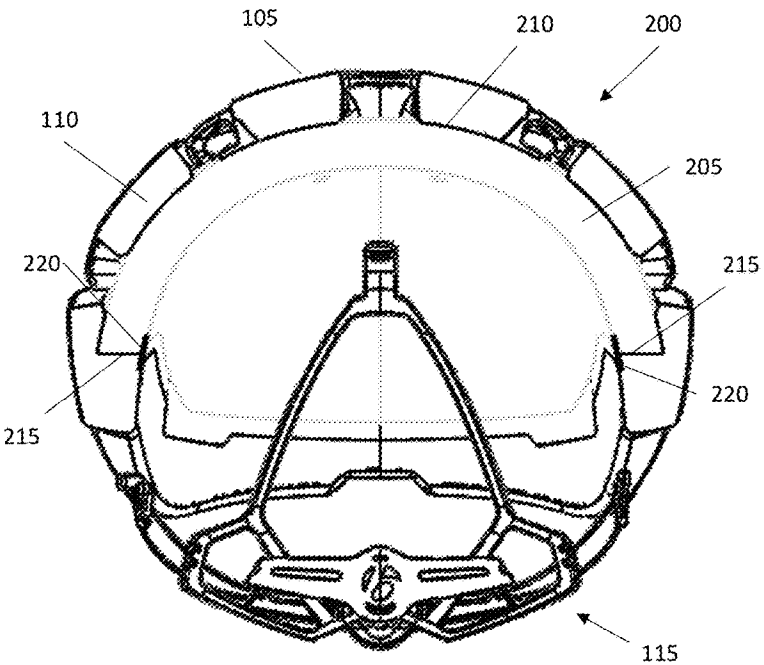
FIG. 2A is a front cross-sectional view of a cycling helmet in accordance with an illustrative embodiment.

FIG. 2A is a front cross-sectional view of a cycling helmet 200 in accordance with an illustrative embodiment. FIG. 2B is a side cross-sectional view of the cycling helmet 200 in accordance with an illustrative embodiment. In addition to the outer shell 105 and the closed cell foam layer 110, FIGS. 2A and 2B depict an insert 205 of energy absorbing material. In an illustrative embodiment, the insert 205 can be formed of plastic, resin, fiber, polycarbonate, polyethylene, terephthalate (PET), acrylonitrile butadiene styrene, polyethylene (PE), polyvinyl chloride (PVC), vinyl nitrile (VN), fiberglass, carbon fiber, aluminum, or other similar material. The insert 205 can be a solid material, or can have a honeycomb configuration with openings to help facilitate deformation. In an illustrative embodiment, the insert 205 is elastically or plasticly deformable and is able to bend, compress, stretch, and shift in multiple directions without shearing.

Figure 3B:
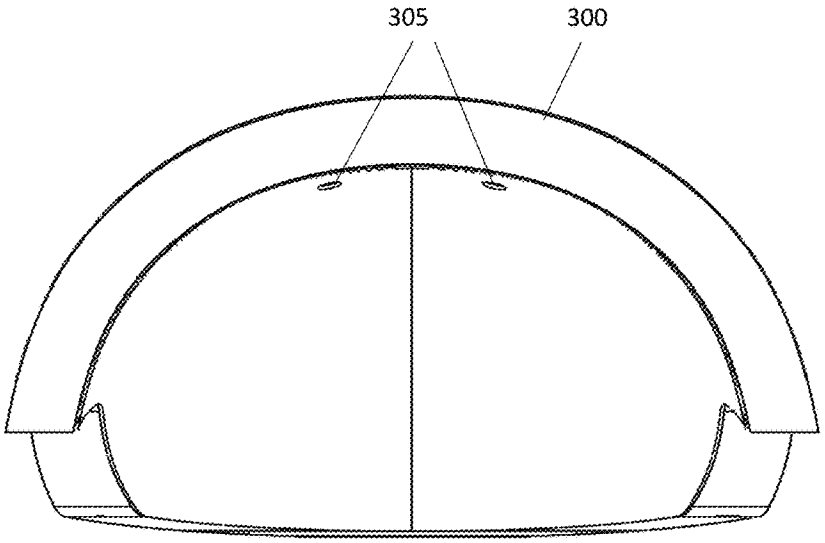
FIG. 3B is a front cross-sectional view of the insert of energy absorbing material in accordance with an illustrative embodiment.
Figure 3A:
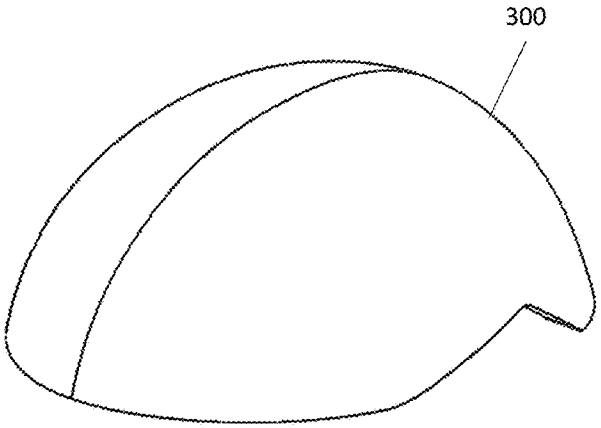
FIG. 3A is a front perspective view of an insert of energy absorbing material in accordance with an illustrative embodiment.
Figure 3C:
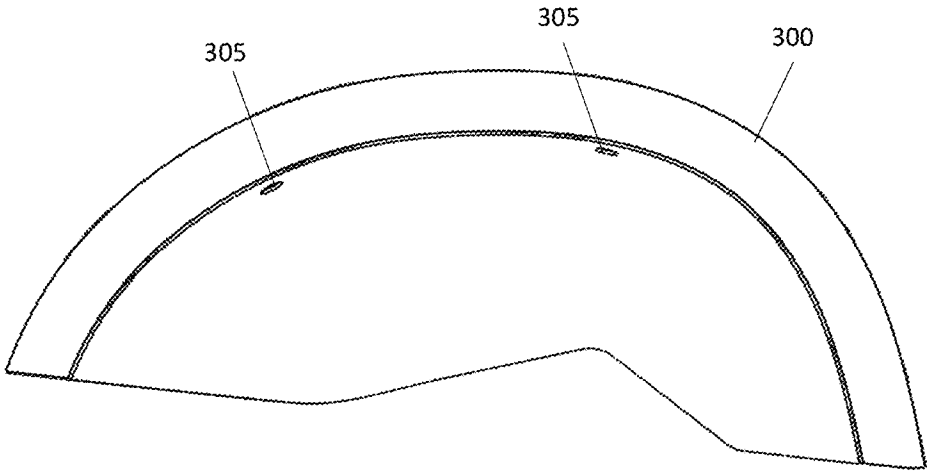
FIG. 3C is a side cross-sectional view of the insert of energy absorbing material in accordance with an illustrative embodiment.

The insert 205 of energy absorbing material is maintained within a largely spherical shape within the cycling helmet 200 such that the insert 205 covers at least a portion of the top, front, and rear of a user's head. FIG. 3A is a front perspective view of an insert 300 of energy absorbing material in accordance with an illustrative embodiment. FIG. 3B is a front cross-sectional view of the insert 300 in accordance with an illustrative embodiment, and FIG. 3C is a side cross-sectional view of the insert 300 in accordance with an illustrative embodiment. In alternative embodiments, the insert may be of a different shape and/or configuration. For example, in one embodiment, the insert may be formed to cover only a top and front (i.e., forehead) of the user's head. In such an embodiment, a thicker closed cell foam layer can be used in the back of the cycling helmet to cover the back of the user's head and to create a uniform contour within the cycling helmet to fit the user's head.

Referring again to FIGS. 2A and 2B, the insert 205 is adjacent to an inner liner 210 which acts as a surface to support the insert 205. The inner liner 210, which is rigid, also provides additional stability and strength to the cycling helmet 200. The inner liner 210 can be formed from polycarbonate or any other suitable material such as carbon, aluminum, etc. In an illustrative embodiment, the inner liner 210 is molded into the cycling helmet 200 and an outer surface of the inner liner 210 is fused to the closed cell foam layer 110 using an adhesive. Similar to the outer shell 105 and the closed cell foam layer 110, the inner liner 210 also includes aligned vent openings to form the vents 130 described with reference to FIG. 1. The inner liner 210 can also include chamfering along the vent openings which aligns with and covers the chamfered edges on the vent openings in the closed cell foam layer 110.

An inner side of the inner liner 210 includes an inner liner coating 212. In an illustrative embodiment, the inner liner coating 212 is a paint that provides a low friction (or slippery) surface for the insert 205 to rest upon. In an alternative embodiment, the inner liner coating 212 may be a powder coat or other low friction substance other than paint. The low friction surface of the inner liner coating enables the insert 205 of energy absorbing material to bend, compress, stretch, and/or otherwise shift in the event of an impact to the cycling helmet 100. Chamfered edges on the vent openings of the inner liner 210 also help facilitate the movement of the insert 205 such that binding of the insert 205 does not occur at the vent openings. In an alternative embodiment in which the inner liner 210 is formed from a low friction material, the inner liner coating may not be used.

As depicted in FIGS. 2A and 2B, the closed cell foam layer 110 forms a shelf 215 that is configured to support a bottom edge of the insert 205. The shelf 215 helps prevent removal of the insert 205 and also acts as a support that maintains the insert 205 in a largely spherical shape within the cycling helmet 200. During an impact, the shelf 215 acts as a stop that helps to prevent the insert 205 from sliding out of the cycling helmet 200.

Depending on the type of material used for the insert 205 of energy absorbing material, the interior edges of the insert 205 may be somewhat abrasive and uncomfortable if in direct contact with skin. An insert cover 220 is used to cover a portion of the inner edge of the insert 205 that is adjacent to the shelf 215. More specifically, the insert cover 220 covers a portion of the closed cell foam layer 110 that is adjacent to the shelf 215 and a portion of an interior surface of the insert 205. In an illustrative embodiment, the insert cover 220 traverses the entire interior perimeter of the cycling helmet 200 to add comfort and protect the user's head from an abrasive surface that may be found on the insert 205. In addition to adding comfort, the insert cover 220 also helps keep the insert 205 in place and helps prevent its removal.

In an illustrative embodiment, the insert cover 220 is formed from polycarbonate. Alternatively, the insert cover 220 may be made of a different material. In another illustrative embodiment, the insert cover 220 can be attached to the fit system 115 and can be mounted to the cycling helmet 200 by way of anchors that are attached to the closed cell foam layer 110 using mushroom plugs. This configuration is depicted and described in more detail with reference to FIGS. 4A-4*k*. In an alternative embodiment, an adhesive can be used to mount the insert cover 220 to the insert 205 and to a portion of the closed cell foam layer 110 adjacent to the shelf 215. In another alternative embodiment, the insert cover 220 may not be attached to the fit system 115.

As depicted in FIGS. 2A and 2B, the insert cover 220 covers only a small portion of the inner surface (or edge) of the insert 205 of energy absorbing material. In one embodiment, an insert coating can be used to cover the remainder of the inner surface of the insert 205 to add comfort and protect the user from the potentially abrasive surface. In an illustrative embodiment, during manufacturing, the inner surface of the insert 205 may be cut with a hot wire cutter. Depending on the type of material used for the insert 205, the use of a hot wire cutter can result in the formation of plastic beads along the inner surface of the insert 205. The plastic beads formed on the inner surface of the insert 205 are able to accept beads of paint which form the insert coating. Once cured, the paint of the insert coating provides a more comfortable surface to the touch and against a user's head. In an alternative embodiment, such an insert coating may not be used.

Figure 4B:
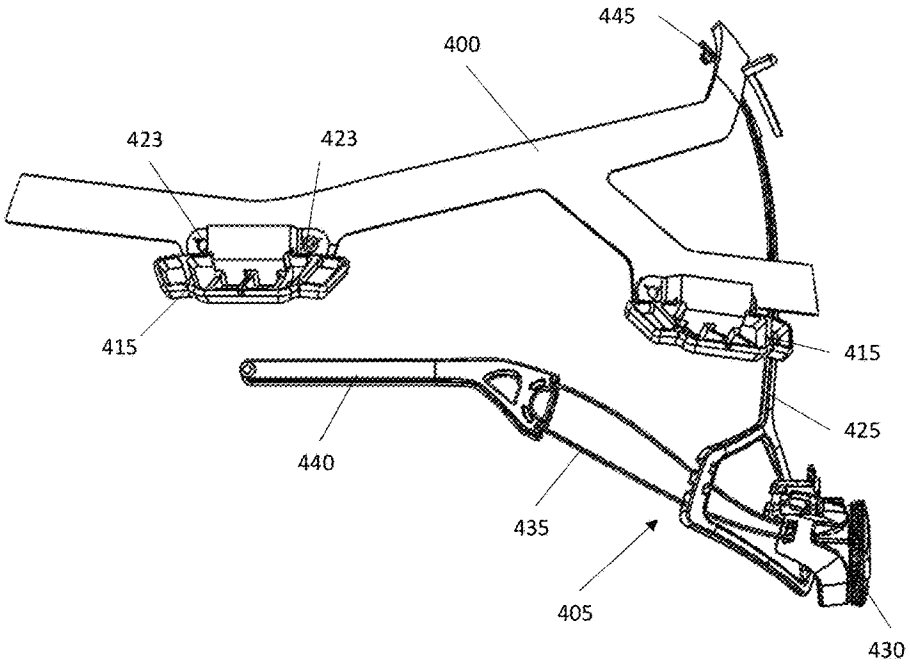
FIG. 4B is a side view of the insert cover mounted to the fit system in accordance with an illustrative embodiment.
Figure 4A:
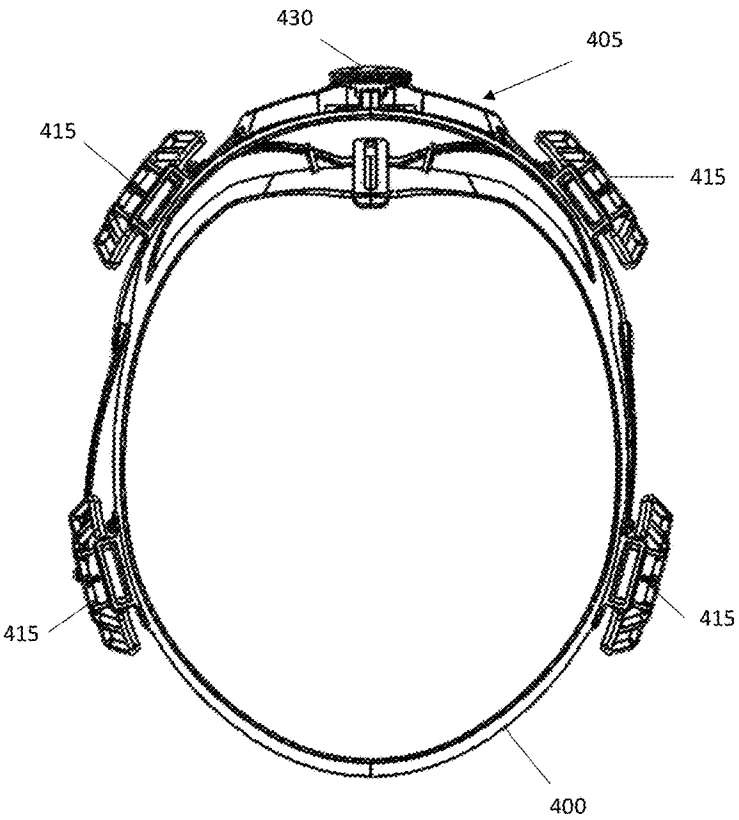
FIG. 4A is a top view of an insert cover mounted to a fit system in accordance with an illustrative embodiment.
Figure 4C:
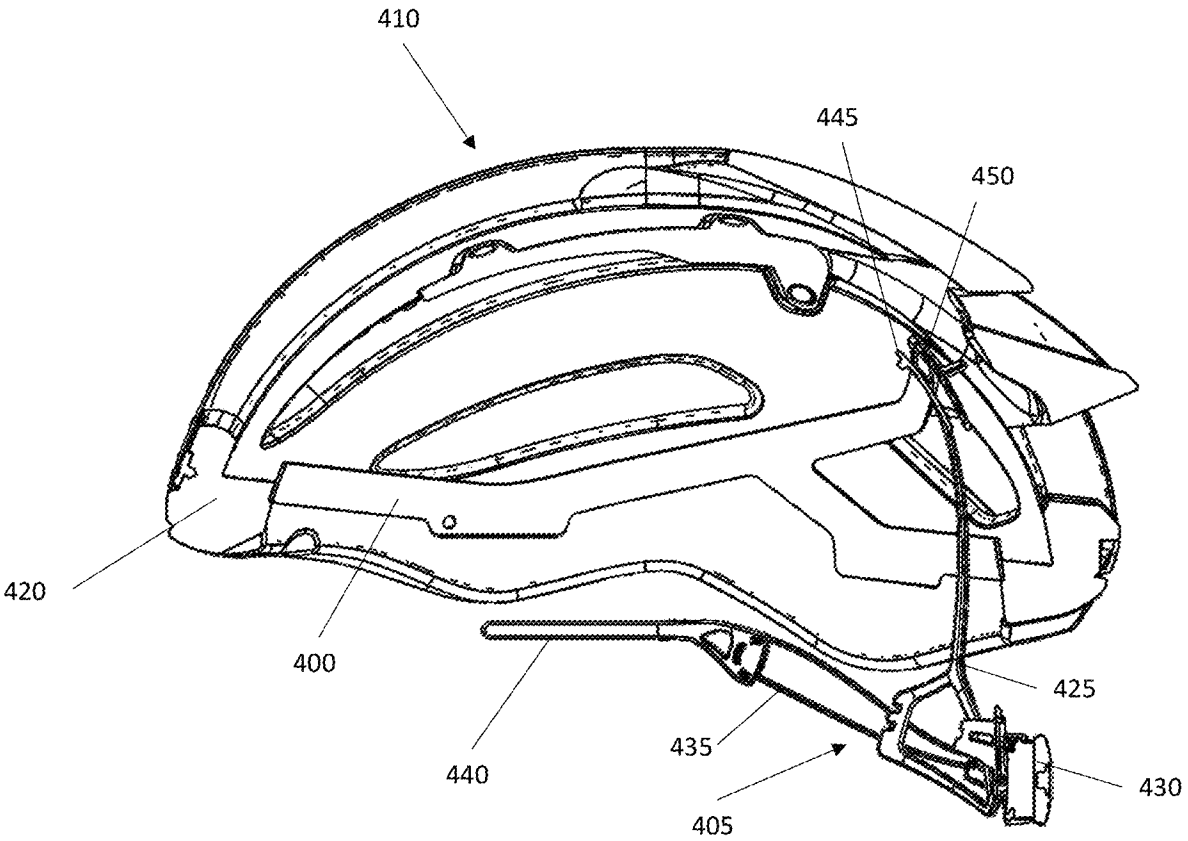
FIG. 4C is a cross-sectional side view of the insert cover and the fit system incorporated into a cycling helmet in accordance with an illustrative embodiment.
Figure 4D:
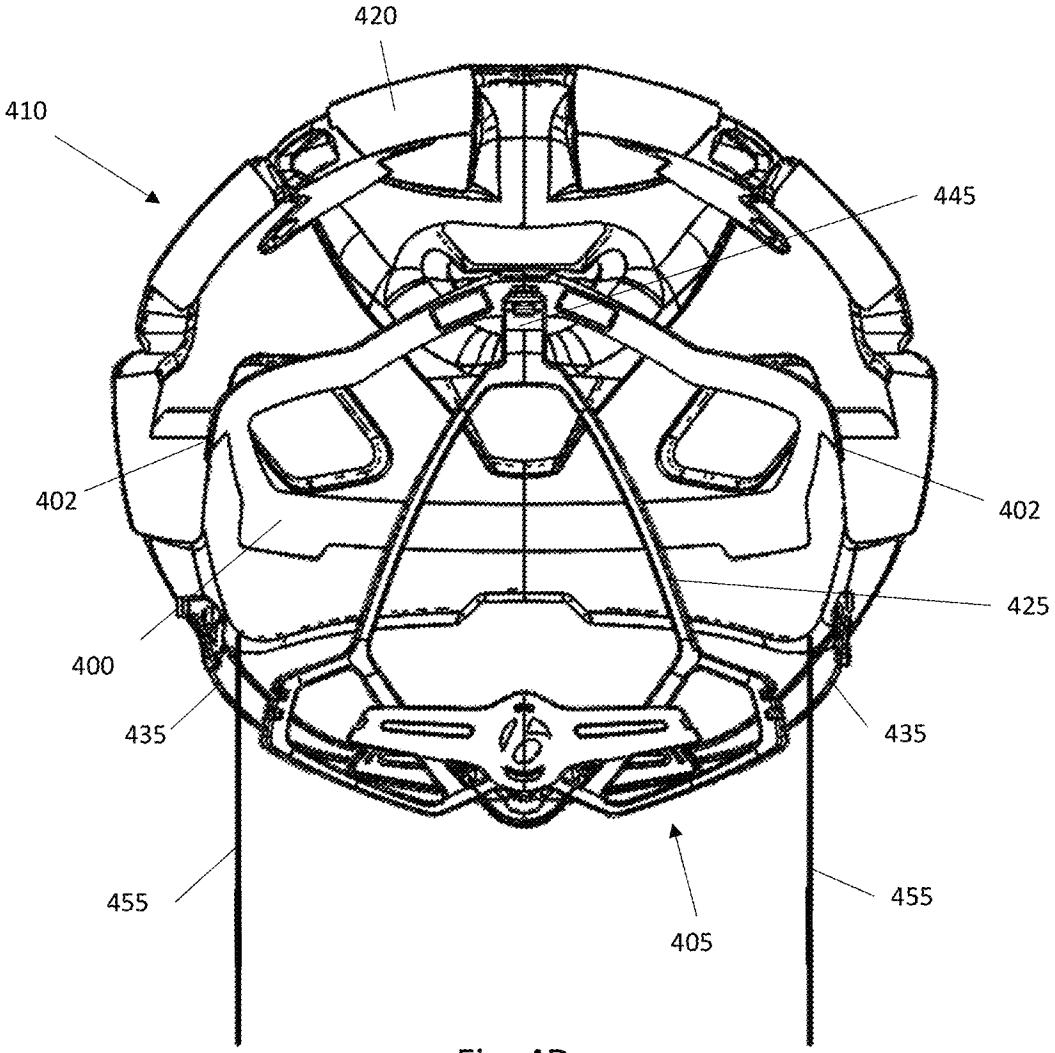
FIG. 4D is a cross-sectional front view of the insert cover and the fit system incorporated into the cycling helmet in accordance with an illustrative embodiment.
Figure 4F:
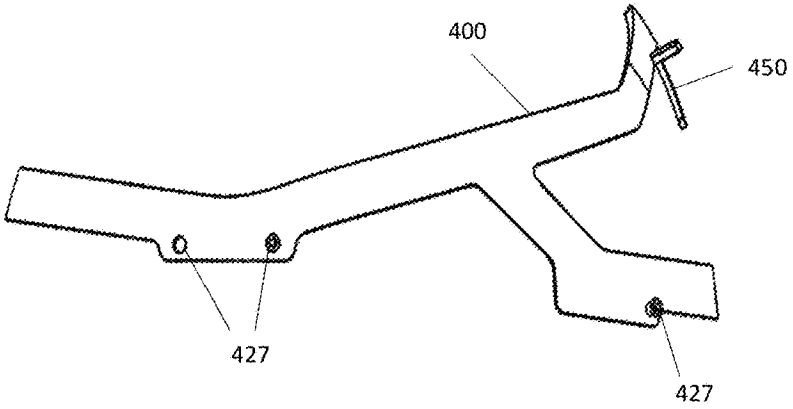
FIG. 4F is a side view of the insert cover in accordance with an illustrative embodiment.
Figure 4E:
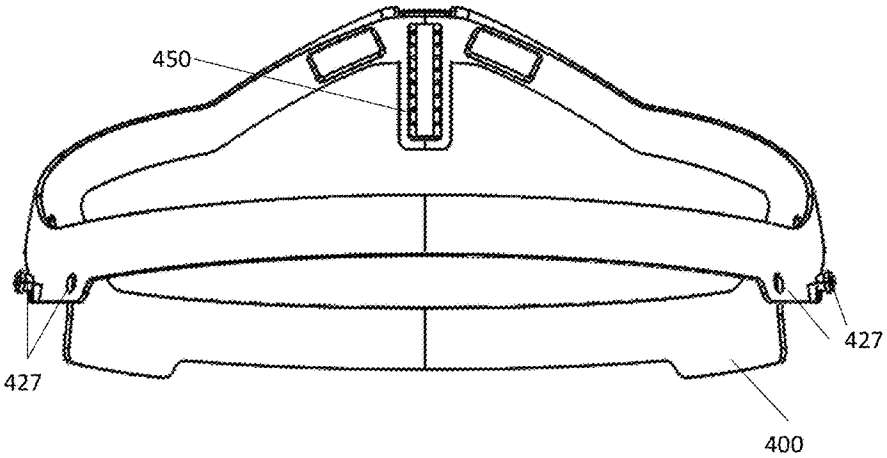
FIG. 4E is a front view of the insert cover in accordance with an illustrative embodiment.
Figure 4H:
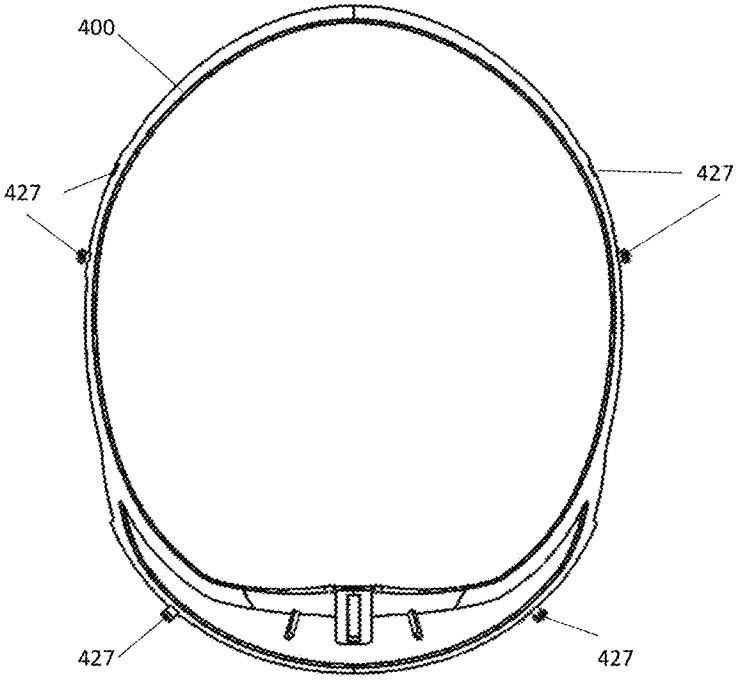
FIG. 4H is a top view of the insert cover in accordance with an illustrative embodiment.
Figure 4G:
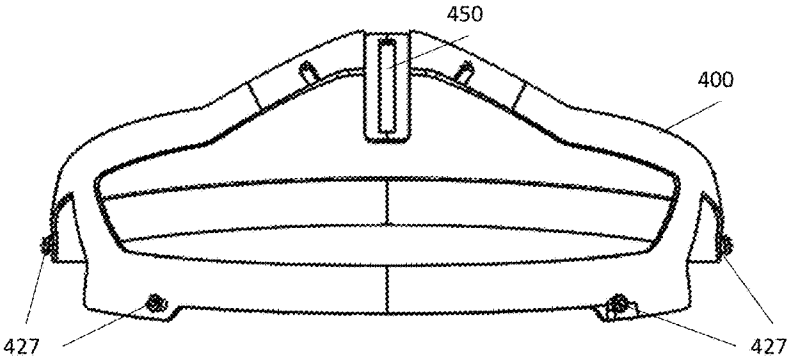
FIG. 4G is a rear view of the insert cover in accordance with an illustrative embodiment.
Figure 4J:
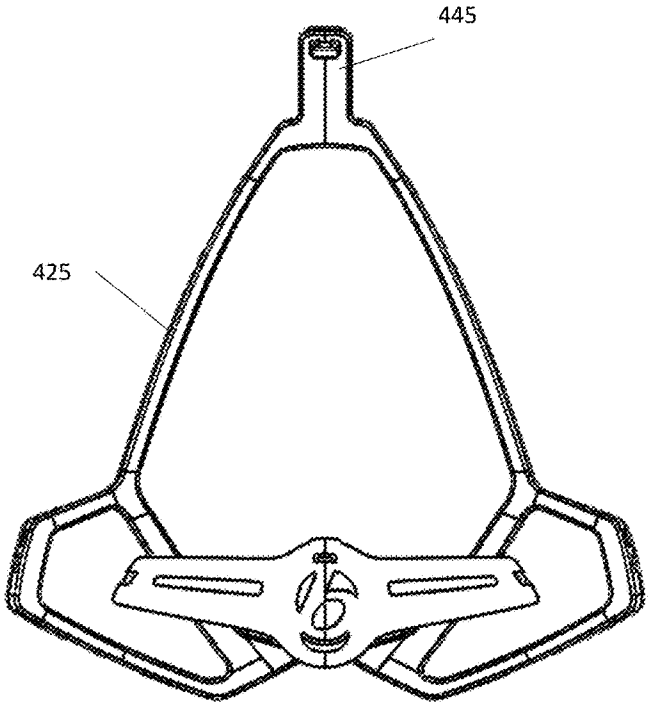
FIG. 4J is a front view of a yoke of the fit system in accordance with an illustrative embodiment.
Figure 4I:
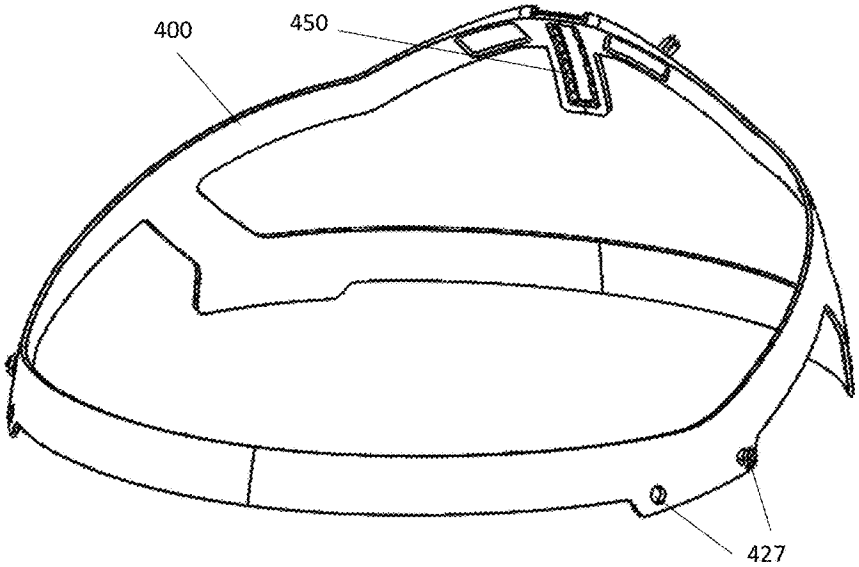
FIG. 4I is a perspective view of the insert cover in accordance with an illustrative embodiment.
Figure 4K:
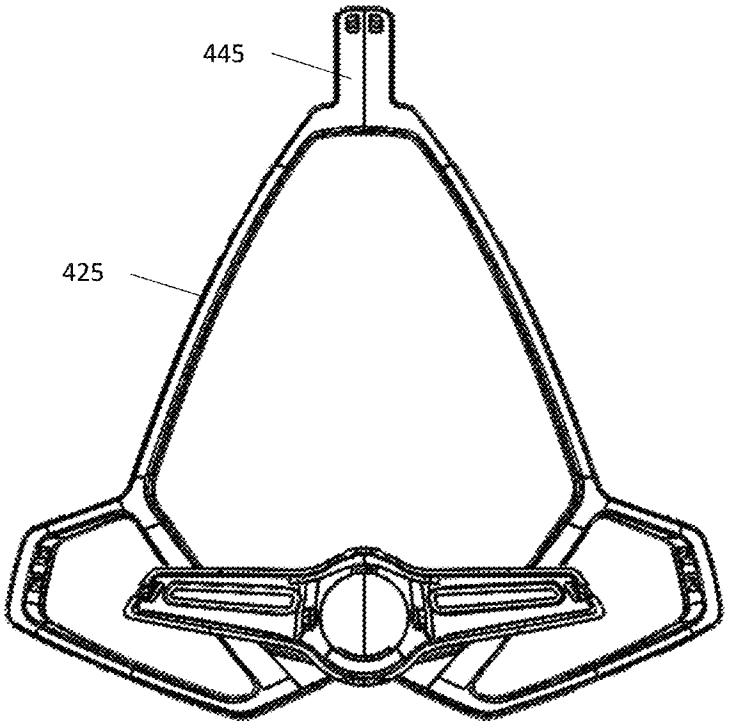
FIG. 4K is a rear view of the yoke of the fit system in accordance with an illustrative embodiment.

In an illustrative embodiment, the insert cover 220 depicted in FIGS. 2A and 2B is mounted to the fit system 115 described with reference to FIGS. 1A-1C. FIG. 4A is a top view of an insert cover 400 mounted to a fit system 405 in accordance with an illustrative embodiment. FIG. 4B is a side view of the insert cover 400 mounted to the fit system 405 in accordance with an illustrative embodiment. FIG. 4C is a cross-sectional side view of the insert cover 400 and the fit system 405 incorporated into a cycling helmet 410 in accordance with an illustrative embodiment. FIG. 4D is a cross-sectional front view of the insert cover 400 and the fit system 405 incorporated into the cycling helmet 410 in accordance with an illustrative embodiment. It is noted that in FIGS. 4C and 4D that the insert is not depicted for clarity. FIG. 4D depicts an inset 402 in a closed cell foam layer 420 such that the insert cover 400 is flush with the closed cell foam layer 420. FIG. 4E is a front view of the insert cover 400 in accordance with an illustrative embodiment. FIG. 4F is a side view of the insert cover 400 in accordance with an illustrative embodiment. FIG. 4G is a rear view of the insert cover 400 in accordance with an illustrative embodiment. FIG. 4H is a top view of the insert cover 400 in accordance with an illustrative embodiment. FIG. 4I is a perspective view of the insert cover 400 in accordance with an illustrative embodiment. FIG. 4J is a front view of a yoke 425 of the fit system 405 in accordance with an illustrative embodiment. FIG. 4K is a rear view of the yoke 425 of the fit system 405 in accordance with an illustrative embodiment.

As depicted in FIG. 4A, the insert cover 400 is mounted to four anchors 415 which in turn are molded or otherwise incorporated into a closed cell foam layer 420. In alternative embodiments, fewer or additional anchors may be used. In one embodiment, the insert cover 400 is mounted to the anchors 415 by way of mushroom plugs 423 that traverse holes 427 in the insert cover 400 and the anchors 415. In alternative embodiments, any other type of fastener or attachment method may be used to mount the insert cover 400 to the anchors 415. The insert, which is not depicted in FIGS. 4A-4K, can include openings that allow the mushroom plugs 423 or other fasteners to pass from the insert cover 400 to the anchors 415 which are incorporated into the closed cell foam layer 420. For example, the openings 305 depicted in the insert 300 of FIGS. 3B and 3C can be used to allow the mushroom plugs 423 to pass from the insert cover 400 to the anchors 415.

Figure 5:
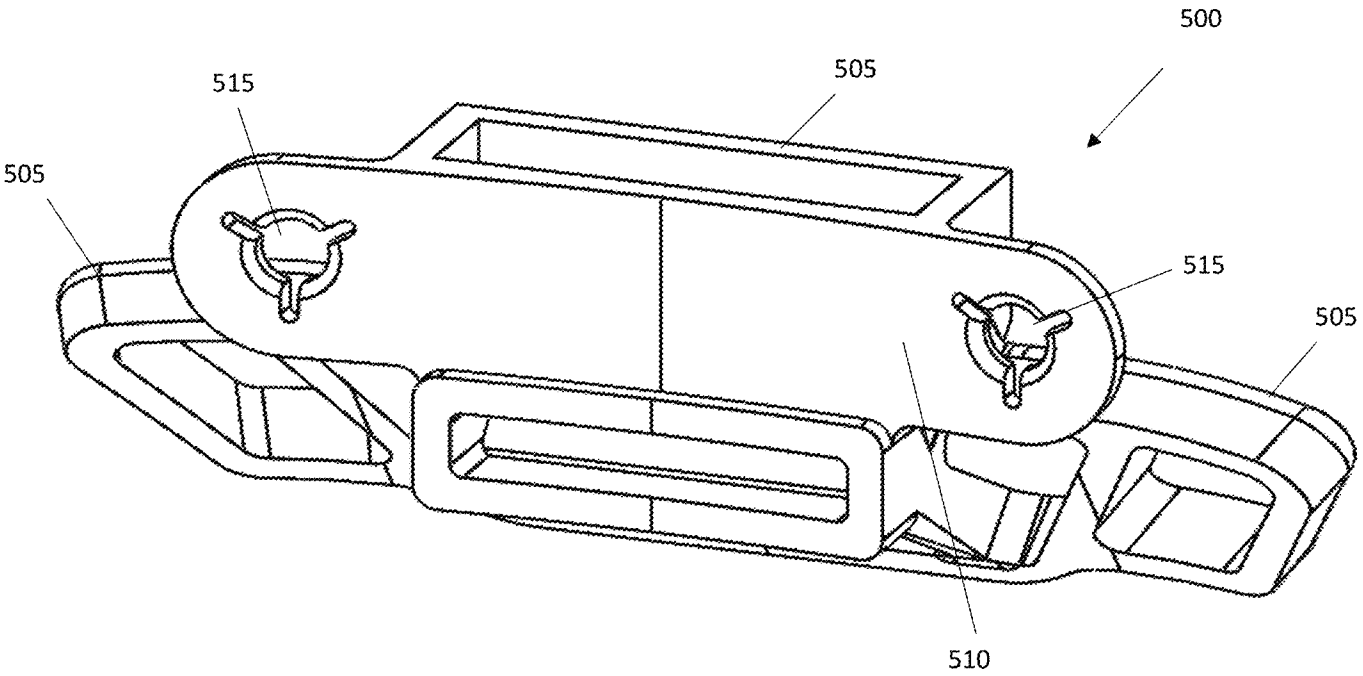
FIG. 5 depicts an anchor in accordance with an illustrative embodiment.

FIG. 5 depicts an anchor 500 in accordance with an illustrative embodiment. A rear framework 505 of the anchor 500 is incorporated into the closed cell foam layer of a cycling helmet such that the closed cell foam layer securely holds the anchor 500 in place. A mounting surface 510 of the anchor 500 faces an interior of the cycling helmet when the anchor 500 is mounted. The mounting surface 510 includes openings 515 that are configured to receive one end of mushroom plugs or other fasteners. The other ends of the mushroom plugs are mounted to an insert cover as discussed with reference to FIG. 4. In an illustrative embodiment, when mounted, the mounting surface 510 of the anchor 500 is flush with an interior surface of the closed cell foam layer. In such an implementation, the mushroom plugs (or other fasteners) extend from the insert cover, through openings in the insert and into the openings 515 of the mounting surface 510. In an alternative embodiment, the mounting surface 510 of the anchor 500, when mounted, may be flush with an interior surface of the insert. In such an embodiment, the insert includes an opening configured to receive the mounting surface 510.

Referring again to FIGS. 4A-4K, it can be seen that the fit system 405 includes a yoke 425. The yoke 425 includes a ratchet device 430 that is used to tighten and loosen cables 435 which are attached to a head strap 440 such that the user can obtain a comfortable and secure fit of the cycling helmet on his/her head. The head strap 440, which is configured to surround at least a portion of the perimeter of the user's head, may include padding for added comfort. A mounting strap 445 of the yoke 425 is used to mount the yoke 425 to the insert cover 400. In an illustrative embodiment, the mounting strap 445 is slidably mounted to a receiving strap 450 of the insert cover 405 such that the yoke 425 can be raised and lowered relative to the user's head. The mounting strap 445 of the yoke 425 can be mounted to the insert cover 400 using a mushroom plug or any other type of fastener known to those of skill in the art.

Figure 6C:
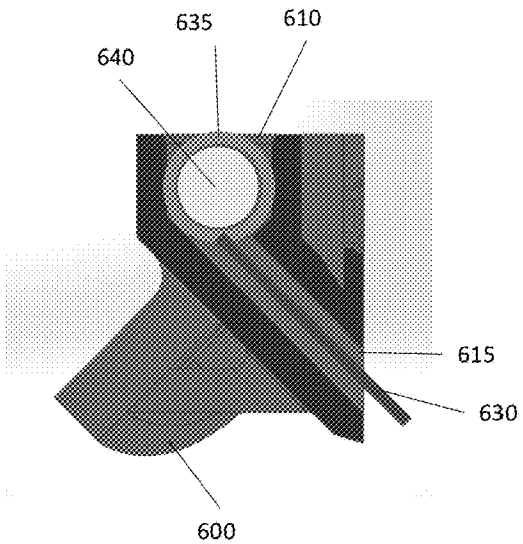
FIG. 6C is a partial cross-sectional view of the anchoring location in FIG. 6A with a strap in accordance with an illustrative embodiment.

As discussed above, the cycling helmet can include straps, such as the straps 455 depicted in FIG. 4D, that are configured to go under a user's chin to help secure the cycling helmet to the user's head. In an illustrative embodiment, these straps 455 can be secured to the fit system 405. In an alternative embodiment, the straps 455 may be independently mounted to the cycling helmet. For example, each of the first strap and the second strap can have two anchor points such that the strap is secured to the closed cell foam layer at four locations. In one embodiment, one of the two anchor points of the first strap is positioned in front of the user's ear when the cycling helmet is worn and the other anchor point is positioned behind the user's ear. Similarly, the two anchor points of the second strap can also be positioned in front of and behind the user's opposite ear when the cycling helmet is worn. Such an embodiment is depicted in FIGS. 6A-6C.

Figure 6B:
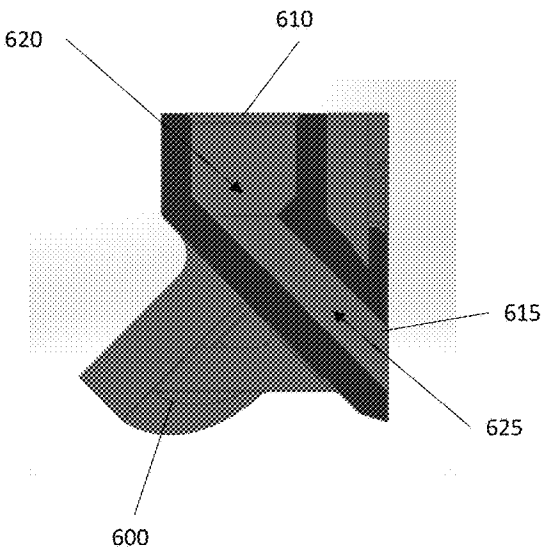
FIG. 6B is a partial cross-sectional view of the anchoring location in FIG. 6A in accordance with an illustrative embodiment.
Figure 6A:
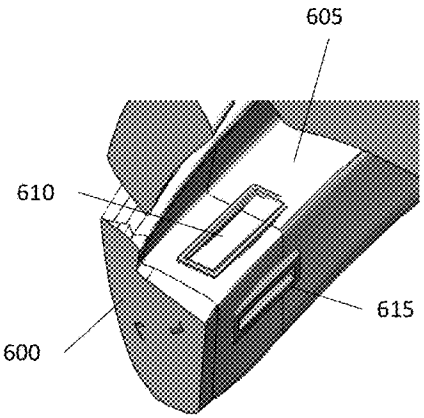
FIG. 6A is a partial perspective view of an anchoring location for a strap in accordance with an illustrative embodiment.

FIG. 6A is a partial perspective view of an anchoring location for a strap in accordance with an illustrative embodiment. The anchoring location for the strap is positioned within a closed cell foam layer 600. As discussed above, the closed cell foam layer 600 includes a shelf 605 that is configured to support a bottom edge of an insert of energy absorbing material. The shelf 605 includes a shelf opening 610 configured to receive and anchor a terminal end of the strap. The shelf opening 610 can be formed in the closed cell foam layer 600. The strap travels down through the shelf opening 610 and out through a side opening 615 in the closed cell foam layer 600 such that the strap is accessible to a user.

FIG. 6B is a partial cross-sectional view of the anchoring location in FIG. 6A in accordance with an illustrative embodiment. The anchoring location includes a first passage 620 which is adjacent to the shelf 605 and the shelf opening 610. The anchoring location also includes a second passage 625 which is adjacent to the side opening 615. As indicated in FIG. 6B, the first passage 620 is wider than the second passage 625. This difference in width enables anchoring of a strap as depicted in FIG. 6C. FIG. 6C is a partial cross-sectional view of the anchoring location with a strap 630 in accordance with an illustrative embodiment. The strap 630 has a loop 635 at its terminal end, and a bar 640 is inserted into the loop 635. The bar 640 is able to fit into the first passage 620, but is unable fit within the second passage 625. As a result, the bar 640 and thus the strap 630 are anchored at the interface between the first passage 620 and the second passage 625. The bar 640 can be metallic or plastic, depending on the implementation.

Figure 7:
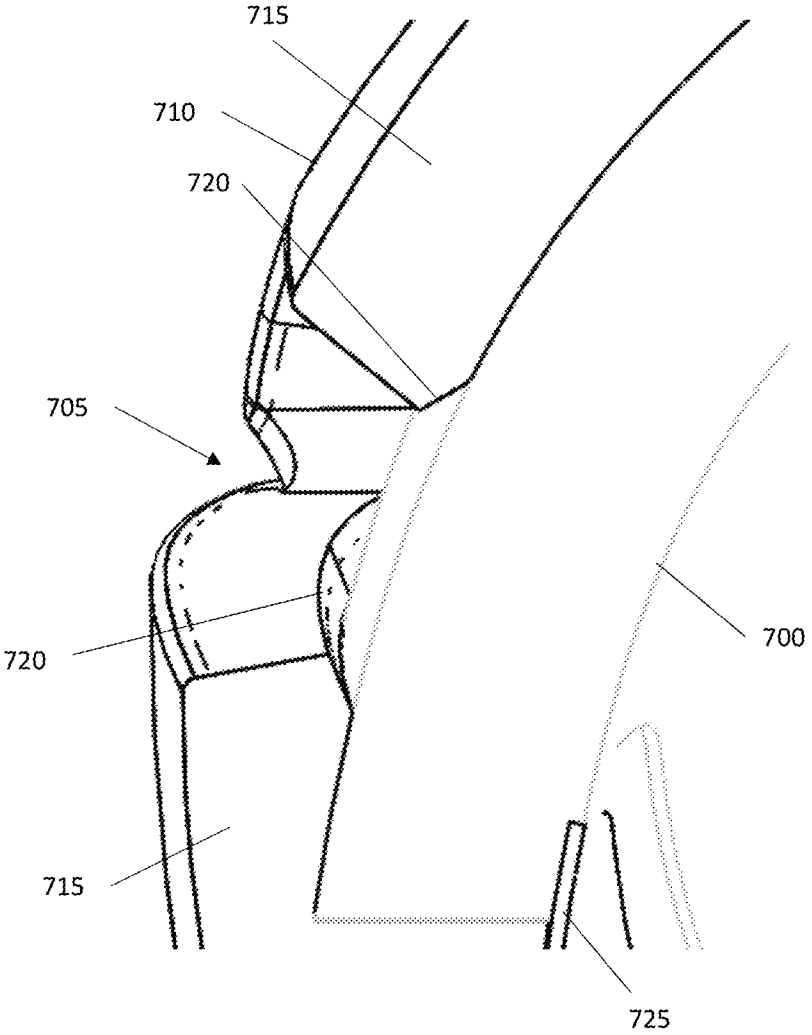
FIG. 7 is a partial sectional view depicting the interface between an insert and a vent of a cycling helmet in accordance with an illustrative embodiment.

FIG. 7 is a partial sectional view depicting the interface between an insert 700 and a vent 705 of a cycling helmet in accordance with an illustrative embodiment. The vent 705 is formed as an opening in both an outer shell 710 and a closed cell foam layer 715 of the cycling helmet. An interior surface of the closed cell foam layer 715 is chamfered to form a chamfered edge 720 along the internal perimeter of the vent 705. The chamfered edge 720 allows the insert 700 to move freely relative to the vent 705 without binding in the event of an impact to the cycling helmet. Also depicted in FIG. 7 is an interface between an insert cover 725, the insert 700, and the closed cell foam layer 715. The interface is formed such that the insert cover 725 is inset into and flush with both the insert 700 and the closed cell foam layer 715. As a result, comfort is improved because the insert cover 725 does not stick out past the insert 700 or the closed cell foam layer 715.

Figure 8:
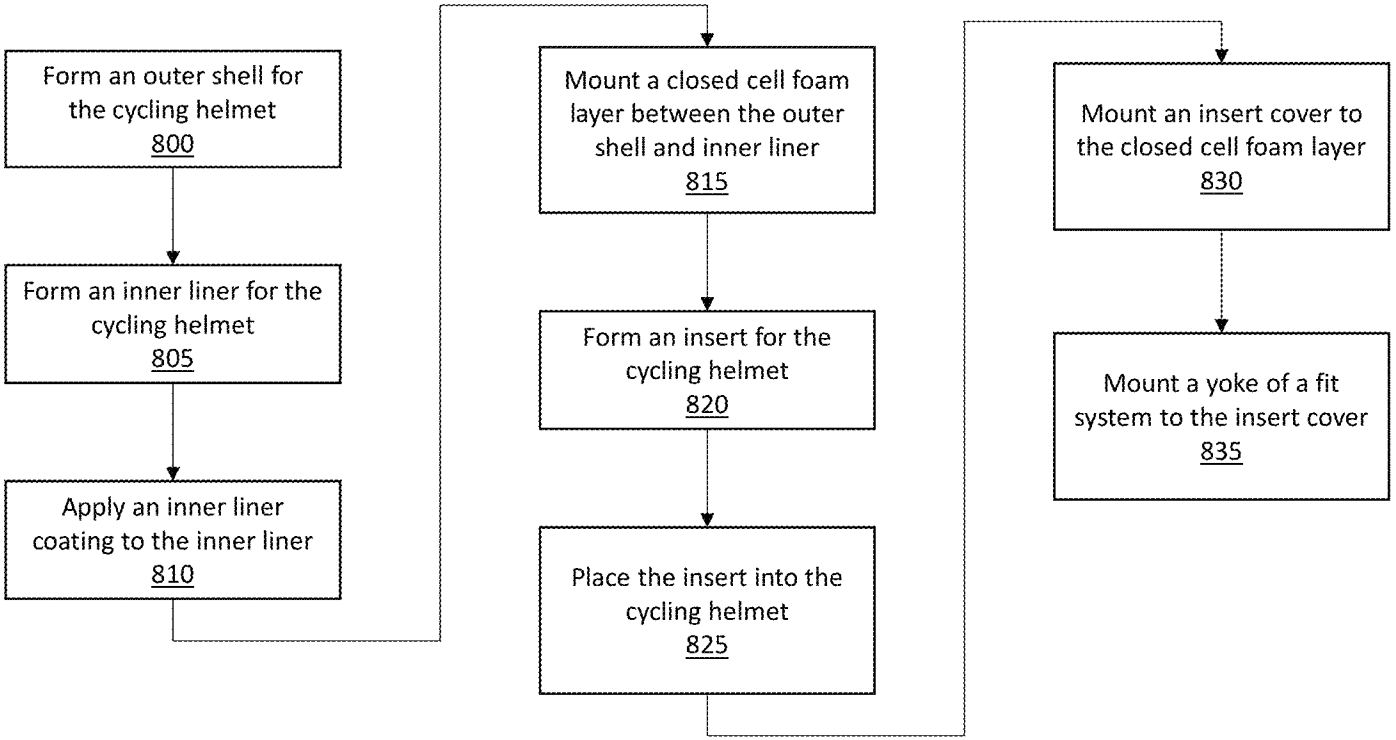
FIG. 8 is a flow diagram depicting operations performed to construct a cycling helmet in accordance with an illustrative embodiment.

FIG. 8 is a flow diagram depicting operations performed to construct a cycling helmet in accordance with an illustrative embodiment. In alternative embodiments, fewer, additional, and/or different operations may be performed. Additionally, the use of a flow diagram is not meant to be limiting with respect to the order of operations performed. In an operation 800, an outer shell is formed for the cycling helmet. In an illustrative embodiment, the outer shell is formed from a sheet of polycarbonate, which is heated and pressure formed around an outer shell mold. Vent openings are then placed into the pressure formed outer shell using a hot knife cutting process. In alternative embodiments, different materials and/or a different process may be used to form the outer shell.

In an operation 805, an inner liner for the cycling helmet is formed. In an illustrative embodiment, the inner liner is formed as a thin layer of a rigid substance such as polycarbonate. Alternatively, other materials may be used. Similar to the outer shell, the inner liner may be formed by heating and pressure molding a sheet of material into the appropriate shape, and then cutting vent openings into the molded unit. In another illustrative embodiment, the vent openings of the inner liner can have a chamfered edge that matches the chamfered edges of the vent openings formed in the closed cell foam layer. In alternative embodiments, different materials and/or a different process may be used to form the inner liner.

In an operation 810, an inner liner coating is applied to an inner surface of the inner liner. The inner liner coating can be a paint that provides a low friction (or slippery) surface for the insert to rest upon. Alternatively, the inner liner coating may be a powder coat or other low friction substance. The low friction surface of the inner liner coating helps allow the insert of energy absorbing material to bend, compress, stretch, and/or shift in the event of an impact. In an alternative embodiment in which a surface of the inner liner is sufficiently slippery on its own, an inner liner coating may not be applied. In one embodiment, the inner liner coating may be applied to the material used to form the inner liner prior to the actual formation of the inner liner.

In an operation 815, a closed cell foam layer is mounted between the outer shell and the inner liner. In an illustrative embodiment, the closed cell foam layer can be made from pre-expanded EPS that is co-molded (or injection molded) with the outer shell and the inner liner in a mold. In such an implementation, the closed cell foam layer is formed and mounted to the cycling element during the injection molding process. In an alternative embodiment, the closed cell foam layer may be formed independent of the outer shell and the inner liner. In such an embodiment, the closed cell foam layer is mounted to the cycling helmet using an adhesive, fasteners, and/or any other techniques. In alternative embodiments, a different material and/or fabrication process may be used. In another illustrative embodiment, the closed cell foam layer is molded to include a shelf to support an insert, vent openings, and a chamfered edge that surrounds the vent openings along the interior surface of the layer. The closed cell foam layer can also be molded such that anchors are incorporated therein to receive a fit system and an insert cover as described herein. The closed cell foam layer can further be molded to include an inset to receive a portion of the insert cover such that the insert cover can be mounted flush with the interior surface of the closed cell foam layer.

In an operation 820, an insert for the cycling helmet is formed. The insert can be formed by molding, cutting from a sheet of material, or by any other fabrication process known in the art. In an illustrative embodiment, the insert can be made of plastic, resin, fiber, polycarbonate, polyethylene, terephthalate (PET), acrylonitrile butadiene styrene, polyethylene (PE), polyvinyl chloride (PVC), vinyl nitrile (VN), fiberglass, carbon fiber, aluminum, or any other suitable material. As discussed above, the insert is able to bend, compress, stretch, and shift in multiple directions without shearing. The insert can be a solid material, or in the form of a honeycomb with openings that facilitate the bending, compression, stretching, and/or shifting of the material. Formation of the insert can also include incorporating openings in the insert through which mushroom plugs or other fasteners can be passed to secure the insert cover to the anchors molded into the closed cell foam layer. Formation of the insert can also include forming an inset in an interior surface of the insert that is configured to receive a portion of an insert cover. In an illustrative embodiment, the insert is formed such that it does not include vent openings such as those present in the outer shell and the closed cell foam layer. In an alternative embodiment, the insert may be formed to include such vent openings which align with those in the outer shell and the closed cell foam layer.

In an operation 825, the insert is placed into the cycling helmet. In an illustrative embodiment, the insert is positioned such that the insert is adjacent to and follows the contour of coated inner liner. The insert is also positioned such that a bottom edge of the insert rests upon the shelf formed in the closed cell foam layer, as described herein.

In an operation 830, an insert cover is mounted to the closed cell foam layer such that the insert cover covers an interior interface between the insert and the shelf formed in the closed cell foam layer. In an illustrative embodiment, the insert cover is mounted such that it is received by insets formed in both the closed cell foam layer and the insert. As a result, the mounted insert cover is flush with both the insert and the closed cell foam layer along the aforementioned interior interface between those components. The insert cover can be mounted via mushroom plugs or other fasteners which connect the insert cover to the anchors molded into the closed cell foam layer.

In an operation 835, a yoke of a fit system is mounted to the insert cover using mushroom plugs or other fasteners. In an illustrative embodiment, the yoke includes a mounting strap that is configured to be received by a receiving strap attached to the insert cover. In alternative embodiments, a different method for mounting the fit system to the cycling helmet may be used.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more".

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A cycling helmet comprising:

an outer shell;

a closed cell foam layer adjacent to the outer shell;

an inner liner adjacent to the closed cell foam layer;

an insert of energy absorbing material adjacent to the inner liner, wherein the insert is configured to move in multiple directions in response to an impact to the cycling helmet; and an insert cover that covers an interface between the insert and the closed cell foam layer.

2. The cycling helmet of claim 1, wherein the closed cell foam layer includes one or more closed cell foam vent openings, and wherein an inner surface of the closed cell foam layer has a chamfered edge along the one or more closed cell foam vent openings.

3. The cycling helmet of claim 2, wherein the inner liner includes one or more inner liner vent openings that align with the one or more closed cell foam vent openings, and wherein the inner liner has a chamfered edge along the one or more inner liner vent openings.

4. The cycling helmet of claim 3, wherein the insert covers the one or more closed cell foam vent openings and the one or more inner liner vent openings.

5. The cycling helmet of claim 1, further comprising an inner liner coating on the inner liner, wherein the inner liner coating is adjacent to an outer surface of the insert, and wherein the inner liner coating comprises a low friction coating.

6. The cycling helmet of claim 5, wherein the inner liner coating comprises a paint.

7. The cycling helmet of claim 1, further comprising a shelf formed into the closed cell foam layer and configured to receive an edge of the insert.

8. The cycling helmet of claim 1, further comprising an inset in the closed cell foam layer, wherein the inset is configured to receive at least a portion of the insert cover such that the insert cover is flush with the closed cell foam layer.

9. The cycling helmet of claim 1, further comprising one or more anchors incorporated into the closed cell foam layer, wherein the insert cover is mounted to the one or more anchors.

10. The cycling helmet of claim 9, wherein the insert cover is mounted to the one or more anchors with one or more mushroom plugs.

11. The cycling helmet of claim 1, further comprising a fit system that includes a yoke, wherein the yoke of the fit system is mounted to the insert cover.

12. The cycling helmet of claim 11, wherein the yoke includes a mounting strap, and wherein the mounting strap is slidably mounted to a receiving strap of the insert cover.

* * * * *